US005683241A

United States Patent [19]

Casselman

[11] Patent Number: 5,683,241

[45] Date of Patent: Nov. 4, 1997

[54] APPARATUS FOR HEATING BOTTLE CAPS

[76] Inventor: David S. Casselman, 409 Goff Field La., Hopkins, S.C. 29061

[21] Appl. No.: 574,777

[22] Filed: Dec. 19, 1995

[51] Int. Cl.[6] ..... F27D 1/08

[52] U.S. Cl. ..... 432/97; 432/102; 34/577; 34/366; 192/382

[58] Field of Search ..... 432/96, 97, 99, 432/100, 101, 102; 219/392, 379, 382; 222/146.2, 146.5; 34/366, 577

[56] References Cited

U.S. PATENT DOCUMENTS

| | | | |
|---|---|---|---|
| 1,829,477 | 10/1931 | Douthitt | 34/366 |
| 1,857,075 | 5/1932 | Wright et al. | 53/141 |
| 2,347,407 | 4/1944 | Goodwin et al. | 53/141 |
| 2,401,511 | 6/1946 | Rue | 221/150 |
| 2,501,291 | 3/1950 | Rue | 53/141 |
| 2,516,278 | 7/1950 | Vore | 53/141 |
| 2,693,522 | 11/1954 | Martin et al. | 219/201 |
| 2,779,856 | 1/1957 | Fahner | 192/382 |
| 2,857,155 | 10/1958 | Dickey | 432/102 |
| 3,007,256 | 11/1961 | Rouy | 192/382 |
| 3,262,213 | 7/1966 | Austin et al. | 34/366 |
| 3,289,383 | 12/1966 | Foss | 53/141 |
| 3,905,317 | 9/1975 | Pacilio | 113/114 R |
| 4,289,481 | 9/1981 | Yano | 432/97 |
| 4,604,853 | 8/1986 | Albrecht et al. | 53/141 X |
| 4,615,123 | 10/1986 | Brown | 34/577 |
| 4,822,573 | 4/1989 | Timmann | 34/577 |
| 5,155,799 | 10/1992 | Andersson et al. | 192/382 |

*Primary Examiner*—Henry A. Bennett
*Assistant Examiner*—Jiping Lu
*Attorney, Agent, or Firm*—Michael A. Mann, PA

[57] ABSTRACT

A method and apparatus for heating a plurality of bottle caps simultaneously. The apparatus comprises a housing with an air blower, resistance heaters and a thermocouple positioned within its interior. Air blown through the interior is heated by resistance heaters and travels through air ducts positioned at the opposite end of the housing. The air duct is positioned in spaced relation to the interior of a hopper and has a series of apertures through which heated air is injected into the hopper's interior. The flow rate of the air is sufficiently high so that the heated air agitates the caps within the hopper and is evenly distributed throughout the interior of the hopper. The temperature of the air is controlled so that the caps are warmed to a temperature within the range of 88° F. to 92° F.

11 Claims, 2 Drawing Sheets

Fig 1
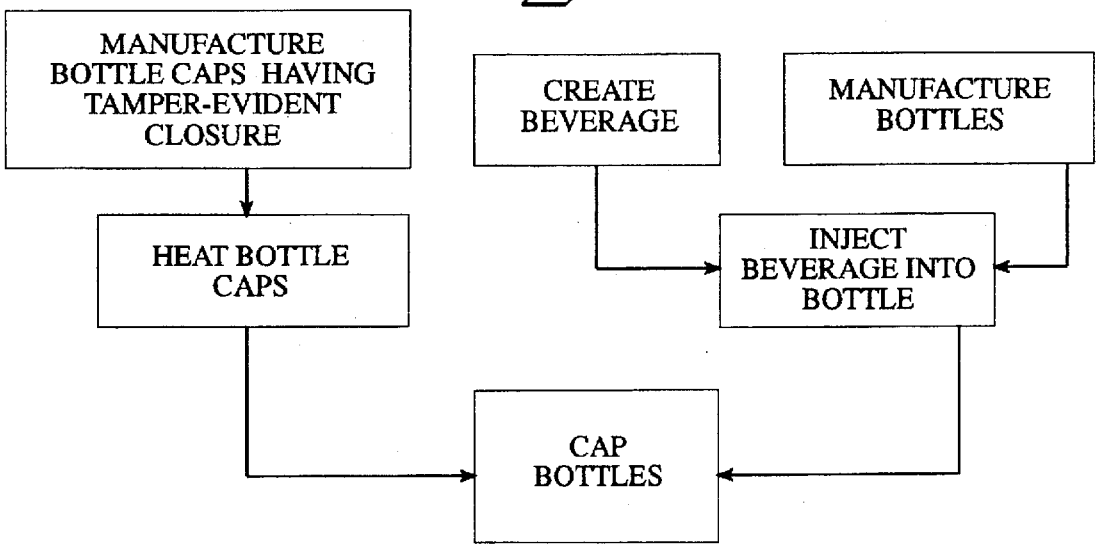
Fig 4
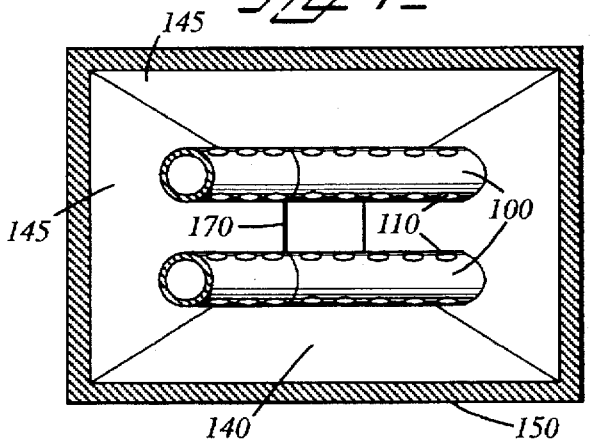
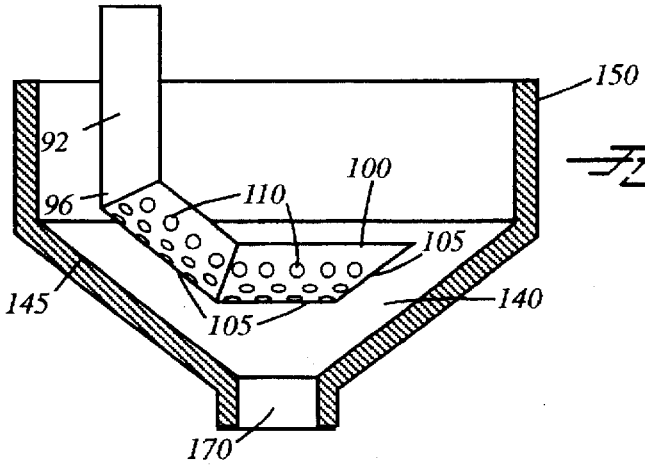
Fig 3

60
30
10
20
152
70
50
90
80
40
200
92
94
160
96
98
100
150
140
200
200
145
110
110
170
200
300

APPARATUS FOR HEATING BOTTLE CAPS

BACKGROUND OF THE INVENTION

1. Field of the Invention

The present invention relates generally to methods and apparatus for heating bottle caps, especially of the type having tamper-evident closures carried thereon. More specifically, the present invention is a method and apparatus for heating a quantity of bottle caps simultaneously.

2. Discussion of Background

It is known in the art to provide tamper-evident closures on bottles, jars and other types of containers which hold beverages, foodstuffs and medicines. These closures provide a visual indication that a bottle or jar has been previously opened and have become a widely accepted means by which a consumer may quickly and easily identify a product that may have been tampered with.

With particular respect to beverage bottles, the most prevalent type of tamper-evident closure is attached to the lower region of a plastic screw cap and comprises an annular band attached to the cap skirt by a series of equally spaced frangible bridges. Normally, during the capping process, the tamper-evident closure is fitted over an annular recess located immediately below the thread on the mouth of a bottle. When the bottle is initially opened, rotation of the cap will break the frangible bridges, separating the band from the screw cap. After initial removal of the cap from the mouth of the bottle, the annular band remains within the recess, providing a visual indication that the bottle has been previously opened.

There are predominately two different types of tamper-evident closures: shrink-fitted and mechanical lock type closures. Shrink-fitted closures are made of a thermally deformable plastic material, which is heat treated to shrink about the container. This procedure takes place after the bottle has been capped, thereby adding an additional process step, and requires the use of thermal energy to tightly shrink the closure about the container.

The disadvantages associated with the use of shrink fitted closures have led the industry to use mechanical lock type closures with more frequency. With mechanical closures, the annular band is formed during the manufacture of the cap and is positioned on the container during the normal capping procedure.

One problem associated with mechanical lock type closures is failure of the frangible bridges during the capping process. When the cap is placed over the mouth of the bottle, the bridges undergo structural deformation when forced over the thread on the mouth of the bottle. This deformation often results in the breaking or tearing of the frangible bridges, which in turn renders the tamper-evident closure useless. Consequently, the bottles having the defective closures must be recapped, thereby increasing the cost of manufacturing.

It has been recognized that applying heat to caps having mechanical lock type closures, prior to the capping procedure, increases the flexibility of the frangible bridges, enabling them fit over the mouth of the bottle without breaking.

U.S. Pat. No. 4,604,853 addresses this issue by providing a method and apparatus that heats the frangible portions of the mechanical lock type closure prior to the capping procedure. The method taught, and the corresponding apparatus, blows heated air on each individual cap as it moves along a conveying means.

However, there exists a need for an apparatus capable of simultaneously heating a plurality of bottle caps.

SUMMARY OF THE INVENTION

According to its major aspects and broadly stated, the present invention is a method and apparatus for heating a plurality of plastic bottle caps carrying mechanical lock tamper resistant closures. The method comprises blowing heated air into a hopper having a plurality of caps held by its interior. The flow rate of the injected air is sufficiently high, preferably no less than 400 cubic feet per minute (CFM), and the temperature is controlled, so that the caps are heated to between 88° F. and 92° F. without excess localized heating as they move from the entrance to the exit of the hopper.

The apparatus of the present invention comprises a housing with a first and opposing second end. The first end of the housing holds an air blower which blows air through the housing interior from the first to the second end. Positioned within the interior of the housing is a series of resistance heaters for heating the air as it travels through the interior of the housing. A thermocouple, in electrical connection with the resistance heaters, maintains the temperature of the air within a prescribed range. Attached to the second end of the housing is at least one air duct having a plurality of apertures through which the heated air flows. The air duct is positioned within the interior of the hopper and spaced a distance apart from the interior walls so that caps migrating to the exit can flow around the duct. The duct is preferably dimensioned to conform to the shape of the interior walls of the hopper to provide an equal amount of heat to all areas of the interior. In a preferred embodiment, the second end of the housing is bifurcated to form a first and second channel having air ducts attached to their ends.

A major feature of the present invention is the combined control of the temperature and flow rate of the air entering the interior of the hopper. These variables are monitored so that the air entering the hopper has a sufficiently high flow rate to agitate the caps in proximity to the air duct, which in turn provides an even distribution of heat throughout the interior of the hopper and avoids temperature gradients. Moreover, the temperature of the air being forwarded through the housing is strictly controlled, with a maximum air temperature heated to less than 120° F., so that the temperature of caps leaving the hopper will be between 88° F. and 92° F. and none of the caps is heated so high that it begins to melt.

Heating a plurality of caps within a hopper is another major feature of the present invention. Providing means to heat the caps en mass, without deviating from the normal processing operation, simplifies the procedure and minimizes the cost of heating the bottle caps.

The air ducts are dimensioned to conform to the interior walls of the hopper and spaced a distance therefrom, which is still another feature of the present invention. By shaping the ducts to conform to the interior walls and keeping them low in the hopper, the heat distribution is kept even and the occurrence of heat pockets within the interior of the hopper is avoided. The caps are quickly heated by the ducts as they move through the hopper. Moreover, the spacing between the interior walls and the air duct is such that the caps can flow freely around the duct, which prevents caps from becoming trapped near the duct. This in turn prevents overheating caps in proximity to the duct and blockages of caps in the hopper.

These and other important features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 1 is a flow chart depicting a method normally used by the industry for capping beverage bottles;

FIG. 3. is a partial cross sectional view showing an air duct positioned within the interior of a hopper according to a preferred embodiment of the present invention; and FIG. 4 is a partial cutaway top view of a pair of air ducts within the interior of a hopper according to a preferred embodiment of the present invention.

DETAILED DESCRIPTION OF A PREFERRED EMBODIMENT

Figure 2:
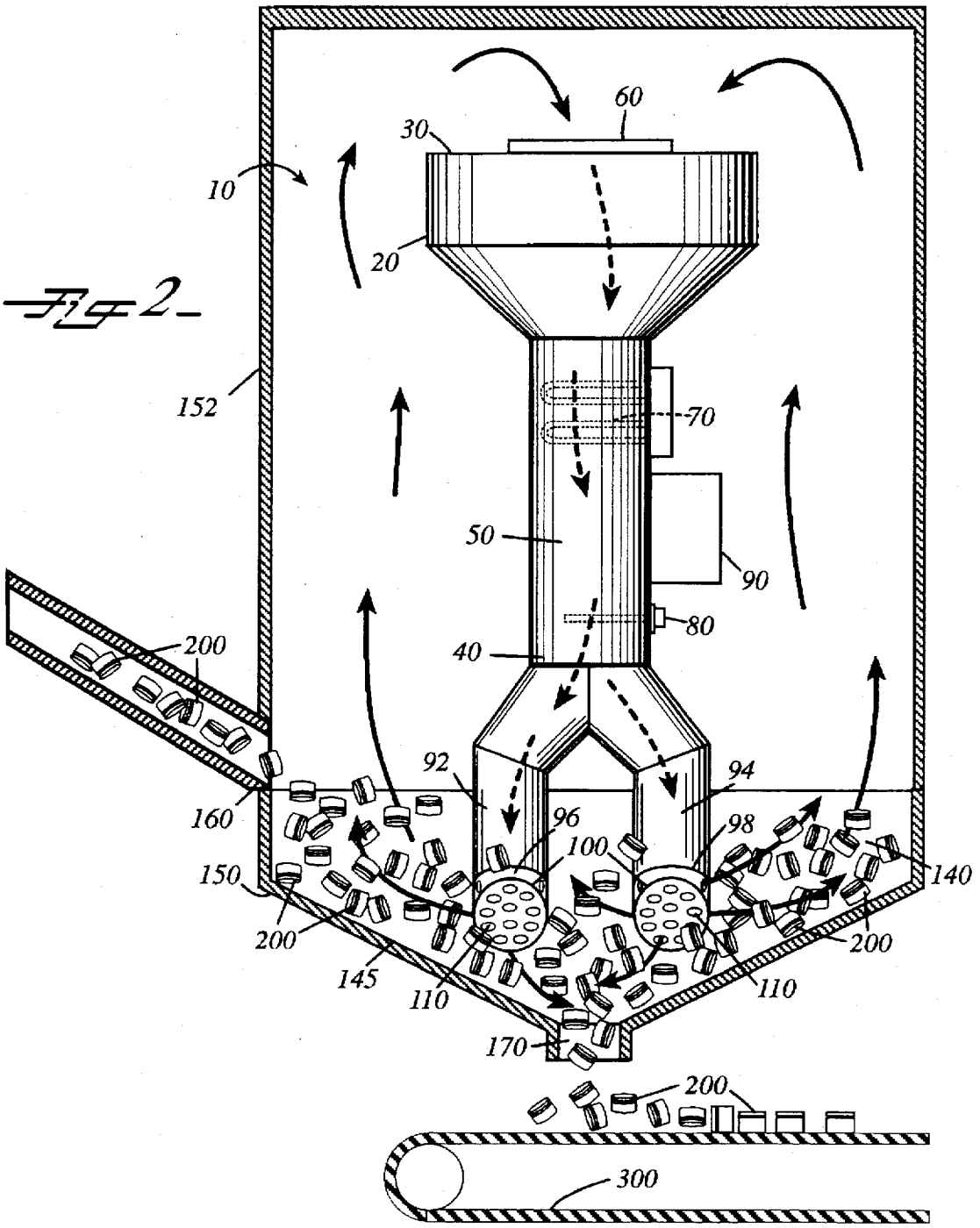
FIG. 2 is a partial cross sectional view of an apparatus for heating bottle caps according to a preferred embodiment of the present invention.

The present invention is a method and apparatus for heating a plurality of bottle caps, each of which carries a tamper-evident closure thereon. Referring now to FIG. 1, there is shown a flow chart depicting a method normally used in the industry for capping bottles and jars.

The process first involves manufacturing the bottle caps having tamper-resistant closures. Separately, both the bottles and the beverages are created in accordance with normal industry procedure. Thereafter, the liquid beverage is injected into the bottles. As this is being done, the caps are forwarded along normal processing lines and are heated immediately before they are screwed onto the bottle mouths. Thereafter, the heated caps are placed in sealing engagement with the bottles.

Turning now to FIGS. 2 and 3, there is shown an apparatus for heating bottle caps, generally indicated by reference numeral 10. Apparatus 10 comprises a housing 20 having a first end 30, a second end 40, and an interior 50. Positioned within interior 50 and proximate to end 30 is a air blower 60. Air blower 60 may be any type commonly employed in the art which has enough power to generate the required air flow rate. A series of resistance heaters 70 are located beyond blower 60 in interior 50 of housing 20. It is appreciated that any industrial type heater capable of heating the air to within the preselected temperature range may be substituted for resistance heaters 70 without departing from the spirit and scope of the present invention. To monitor the temperature of the air traveling through interior 50 of housing 20, a thermocouple 80 is positioned within interior 50. Blower 60, resistance heaters 70 and thermocouple 80 are operationally connected to a control panel 90.

Second end 40 of housing 20 is bifurcated to form a first channel 92 and a second channel 94. Attached to ends 96 and 98 of channel 92 and 94, respectively, are air ducts 100. Formed in air ducts 100 are a plurality of apertures 110 through which air flows.

Air ducts 100 are positioned within interior 140 of hopper 150. Both hopper 150 and apparatus 10 are enclosed by enclosure 152. Hopper 150 has an entrance 160 through which bottle caps 200 are loaded into interior 140. Caps 200 travel down through interior 140 and are unloaded from hopper 150 through exit 170. It is appreciated that at any given time during normal processing, there is a plurality of bottle caps 200 within interior 140, migrating towards exit 170. In most bottling processes, there can be 2000 or more caps in the hopper at any one time. It is also known that unheated caps 200 are continuously being loaded into interior 140 through entrance 160, and heated caps 200 are continuously unloaded from exit 170. Upon leaving hopper 150, caps 200 are forwarded by conveying means 300 to the next processing operation.

Referring now to FIG. 4, there is shown a cross sectional view of air ducts 100 positioned within interior 140 of hopper 150. Preferably, ducts 100 are dimensioned to have a bottom surface 105 that conforms to the shape of interior walls 145 of hopper 150. Thus, for purposes of example only, if hopper 150 had circularly shaped interior walls, ducts 100 would have a circular bottom surface with approximately the same degree of curvature as the interior walls.

In operation, caps 200 are forwarded into interior 140 of hopper 150. Thereafter, air ducts 100 are placed within interior 140 of hopper 150 a distance apart from interior walls 145. This spacing provides a path for caps 200, enabling them to flow around air ducts 100 toward exit 170. Blower 60, resistance heaters 70, and thermocouple 80 are then activated. The air flow rate generated by blower 60 must be high enough, preferably no less than approximately 400 cubic feet per minute, to agitate caps 200 contained within hopper 150. This flow rate permits the diffusion of heated air throughout interior 140 to effectively and evenly heat caps 200 contained therein. The temperature of the air heated by resistance heaters 70 is monitored by thermocouple 80 and is heated to a temperature, no greater than 120° F., the upper setpoint of temperature, and preferably less than 115° F., which is sufficiently high so that air flowing through housing 20 can heat caps 200 to a temperature between 88° F. and 92° F.

Air is accelerated by blower 60 through interior 50 of housing 20 from first end 30 to second end 40. At second end 40, heated air continues to move through channels 92 and 94 and is subsequently injected into interior 140 of hopper 150 through apertures 110 in air ducts 100. Heated air within interior 140 agitates caps 200 and heats them to a temperature between 88° F. and 92° F. as they move from entrance 160 to exit 170. Heated caps 200 are then unloaded from hopper 150 through exit 170 and are conveyed to the capping operation via conveying means 300. Heated air rises from the interior 140 of hopper 150 and is prevented from escaping by enclosure 152. The air is then recycled by blower 60.

It will be apparent to those skilled in the art that many modifications and substitutions can be made to the preferred embodiment just described without departing from the spirit and scope of the invention as defined in the appended claims.

What is claimed is:

1. An apparatus for heating bottle caps comprising:

a hopper, said hopper having an interior, an entrance and an exit;

a housing, said housing having a first end and an opposing second end and an interior, wherein said second end of said housing is bifurcated to form a first channel and a second channel;

a first air duct attached to said first channel and located in said hopper, said first air duct having a plurality of apertures formed therein, said air first duct being in spaced relation to said hopper so that when air flows from said first air duct, it enters said hopper;

a second air duct attached to said second channel and located in said hopper, said second air duct having a plurality of apertures formed therein, said second air duct being in spaced relation to said hopper so that when air flows from said second air duct, it enters said hopper;

means for blowing air at a preselected flow rate through said interior of said housing from said first end of said housing through said first and said second air duct;

means for heating said air to a preselected temperature, said heating means positioned in said interior of said housing; and means for monitoring said temperature of said air, said monitoring means positioned in said interior of said housing, said heating means being responsive to said monitoring means.

2. The apparatus as recited in claim 1, wherein said first air duct and said second air duct are positioned in said interior of said hopper.

3. The apparatus as recited in claim 1, wherein said first air duct and said second air duct are positioned in said interior of said hopper and spaced apart from said interior of said hopper so that said bottle caps can flow around said first air duct and said second air duct in moving from said entrance to said exit of said hopper as said caps are heated.

4. The apparatus as recited in claim 1, wherein said monitoring means is a thermocouple.

5. The apparatus as recited in claim 1, wherein said hopper has an interior wall, said interior wall having a shape, wherein said first air duct and said second air duct each have a bottom surface, and wherein said bottom surface of said first and said second air duct conforms to said shape of said interior wall of said hopper.

6. The apparatus as recited in claim 1, wherein said preselected flow rate is greater than or equal to approximately 400 cubic feet per minute and wherein said preselected temperature is less than 115° F. for heating said caps to a temperature between approximately 88° F. and 92° F. upon exiting said hopper.

7. An apparatus for heating a plurality bottle caps comprising:

a hopper, said hopper having an interior, an entrance and an exit;

a housing, said housing having a first end and an opposing second end and an interior, wherein said second end of said housing is bifurcated to form a first channel and a second channel;

a first air duct attached to said housing and located in said hopper, said first air duct having a plurality of apertures formed therein, said first air duct being positioned in said interior of said hopper so that when air flows from said first air duct, it enters said a second air duct attached to said housing and located in said hopper, said second air duct having a plurality of apertures formed therein, said second air duct being positioned in said interior of said hopper so that when air flows from said second air duct, it enters said hopper;

means for blowing air at a preselected flow rate through said interior of said housing from said first end of said housing through said first air duct and said second air duct;

means for heating said air to a preselected temperature, said heating means positioned in said interior of said housing; and a thermocouple, said thermocouple positioned in said interior of said housing, said heating means being responsive to said thermocouple.

8. The apparatus as recited in claim 7, wherein said preselected flow rate is high enough so that preselected temperature is less than 115° F. for heating said caps to a temperature between approximately 88° F. to 92° F. upon exiting said hopper.

9. The apparatus as recited in claim 7, wherein said preselected flow rate is greater than or equal to approximately 400 cubic feet per minute.

10. The apparatus as recited in claim 7, wherein said preselected flow rate and said preselected temperature are selected so that said bottle caps are heated to a temperature between approximately 88° F. and 92° F. upon leaving said exit of said hopper.

11. The apparatus as recited in claim 7, wherein said hopper has an interior wall, said interior wall having a shape, wherein said first air duct and said second air duct each have a bottom surface, and wherein said bottom surface of said first and said second air duct conforms to said shape of said interior wall of said hopper.

* * * * *